US005706636A

United States Patent [19]

Eckl

[11] Patent Number: 5,706,636

[45] Date of Patent: Jan. 13, 1998

[54] ENVELOPE-STUFFING DEVICE

[75] Inventor: Robert Eckl, Augsburg, Germany

[73] Assignee: Böwe Systec AG, Augsburg, Germany

[21] Appl. No.: 646,253

[22] PCT Filed: Oct. 26, 1994

[86] PCT No.: PCT/EP94/03519

§ 371 Date: May 10, 1996

§ 102(e) Date: May 10, 1996

[87] PCT Pub. No.: WO95/13197

PCT Pub. Date: May 18, 1995

[30] Foreign Application Priority Data

Nov. 12, 1993 [DE] Germany ..... 9317366 U

[51] Int. Cl.[6] ..... B65B 43/26

[52] U.S. Cl. ..... 53/569; 53/284.3; 53/381.5

[58] Field of Search ..... 53/460, 467, 468, 53/473, 475, 492, 284.3, 381.1, 381.3, 381.5, 381.7, 387.1, 387.2, 569

[56] References Cited

U.S. PATENT DOCUMENTS 4,781,013 11/1988 Depasquale et al. ..... 53/381.7

5,408,811 4/1995 Satake ..... 53/569

*Primary Examiner*—John Sipos

*Assistant Examiner*—Ed Tolan

*Attorney, Agent, or Firm*—McGlew and Tuttle

[57] ABSTRACT

The present invention pertains to the object of substantially increasing the performance of an envelope-stuffing machine. While EP-A-0 504 114 discloses the use of rotating elements for opening the envelopes and for grasping the envelope flaps for this purpose, the present invention suggests that the opening and grasping of the envelopes (20) be performed in one conveying plane (13), and the introduction of the envelope contents (21) be performed in a conveying plane (12) arranged offset in relation thereto at another level, and that a link chain (10) with a plurality of spreading members (9) be provided between them, which is movable at right angles to the conveying planes (12, 13) and keeps the envelopes (20) picked up by the spreading members (9) ready at another point for the introduction of the envelope contents (21) and discharges them.

7 Claims, 6 Drawing Sheets

ENVELOPE-STUFFING DEVICE

Figure 1:
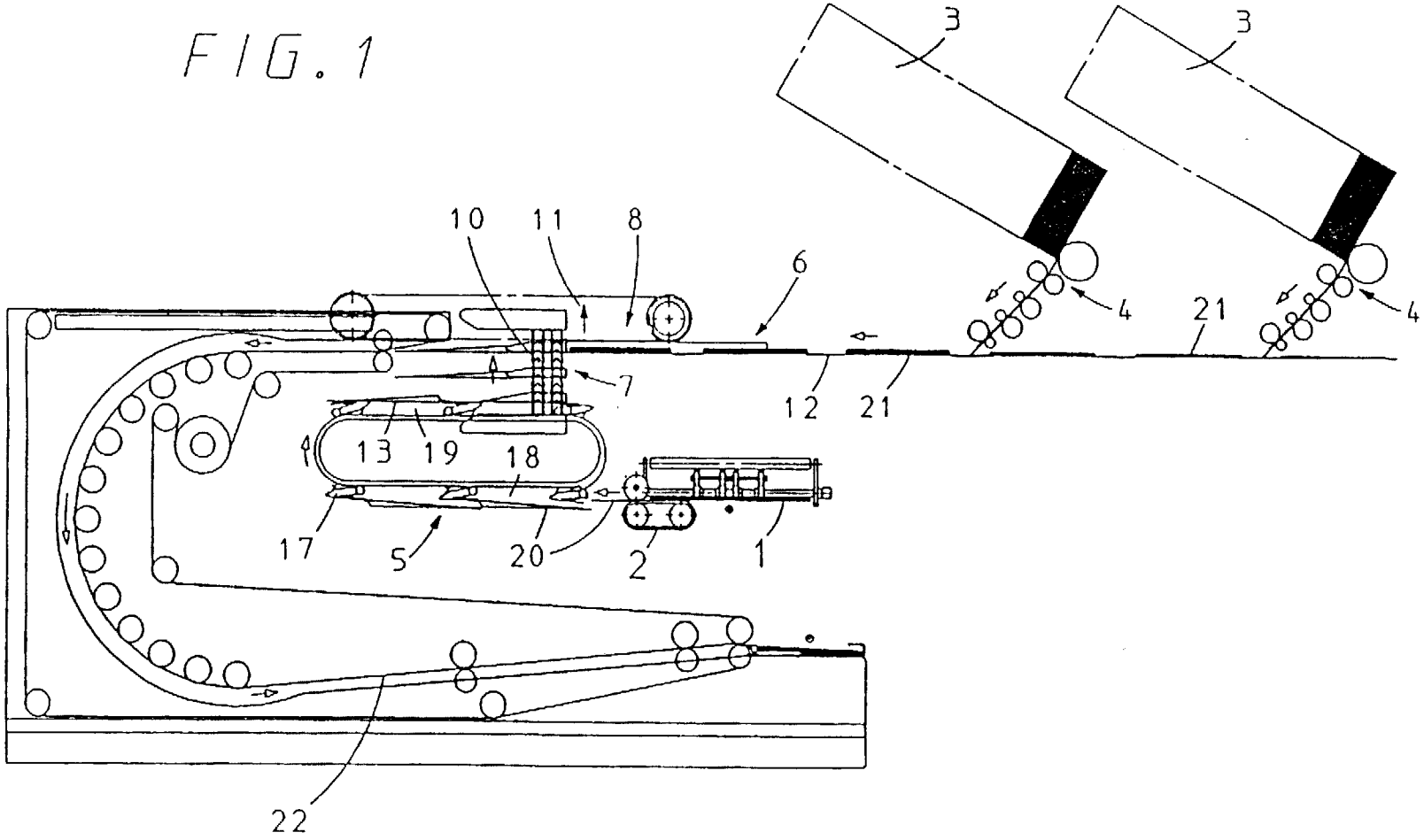

The present invention pertains to an envelope-stuffing device with a stacking device and a pull-off device each for the envelopes and for the envelope contents, as well as with a device for spreading the envelopes and for introducing the envelope contents into the spread envelope, along with a conveyor for removing the stuffed envelopes.

Prior-art envelope-stuffing machines of this class have a limited output, because the opened envelope pulled off from the stack must be pulled from one side onto a so-called packing pocket, with which the envelope is also spread at the same time. The envelope contents are then fed into the packing pocket from the other side and pushed into the envelope. Consequently, the two processes take place one after another and thus limit the maximum efficiency of the envelope-stuffing device.

The task of approximately doubling the stuffing speed has been known from EP-A 0 504 114. The reciprocating movements of different elements in the prior-art envelope-stuffing machine were believed to be the cause of the impossibility of increasing the output. It is suggested in EP-A 0 504 114, instead, that an increase in output be brought about by performing the opening and the pulling off of the envelopes from the stack by means of rotating elements, which are mounted on a common axis, but are driven differently. However, this disclosure also involves the use of a packing pocket, onto which the envelope fed in must first be pulled in order to introduce the envelope contents into the envelope from the other side.

In contrast, the basic object of the present invention is to bring about the desired increase in output by working with a plurality of packing pockets in such a way that one envelope is [pulled] onto one packing pocket and another envelope at another point is stuffed with the envelope contents at the same time in order to thus substantially reduce the cycle times.

This object is accomplished according to the present invention by the device for spreading and keeping ready the envelopes being designed as a link chain equipped with a plurality of spreading members, whose conveying plane extends at right angles to and between the conveying planes for the envelopes and the envelope contents, which are located at different levels, wherein the individual spreading member picks up the opened envelope in one conveying plane during the stopped phase and keeps the envelope received ready for pushing in the envelope contents in the other conveying plane.

Consequently, the cycle time is reduced in the subject of the present invention by the pulling of the envelope onto the spreading member (packing pocket) taking place simultaneously with the pushing of the envelope contents into another envelope and by the time needed to feed in or pull off an envelope being used to move the spreading members from the envelope pick-up station into the discharge station.

Advantageous embodiments of the present invention are disclosed in claims 2 through 6. It is advantageous, e.g., according to claim 2 to allow the conveyors for the envelopes and for the envelope contents to revolve continuously and the link chain intermittently. An additional increase in output is achieved as a result, because the times for pulling the envelopes onto the spreading member and for stuffing in the envelope contents and for pulling off the stuffed envelope can be further reduced.

According to claim 3, it is recommended that the conveyors for the envelopes and for the envelope contents be allowed to revolve in the transfer area in the horizontal plane (at levels one on top of another) and the link chain in the vertical direction.

Another subject of the present invention pertains to the special design of the link chain according to claim 4. According to this claim, the link chain comprises two individual chains, which are arranged at spaced locations from one another, revolve around mutually parallel axes, and on which the spreading members are arranged in the same plane, directed toward each other. The envelope fed in can consequently be spread with ease during the pulling onto the two spreading members aligned in parallel to one another, which leads to the advantage that a larger amount of envelope contents can be fed in. The spreading members loaded with the envelope are displaced intermittently into a raised level, which prevents collisions with the gripping tools for the envelopes. It is therefore advantageous for the individual chain to have at least four, but preferably eight spreading members arranged at equally spaced locations from one another.

To reduce the cycle times, provisions are made according to claim 6 of the present invention for the conveyor for the envelopes to have a plurality of grippers arranged at equally spaced locations from one another for grasping the flaps of the envelopes, to take over the envelopes from a stack pull-off device in its lower strand, and to transfer the envelopes to the spreading members in its upper strand.

Figure 2:
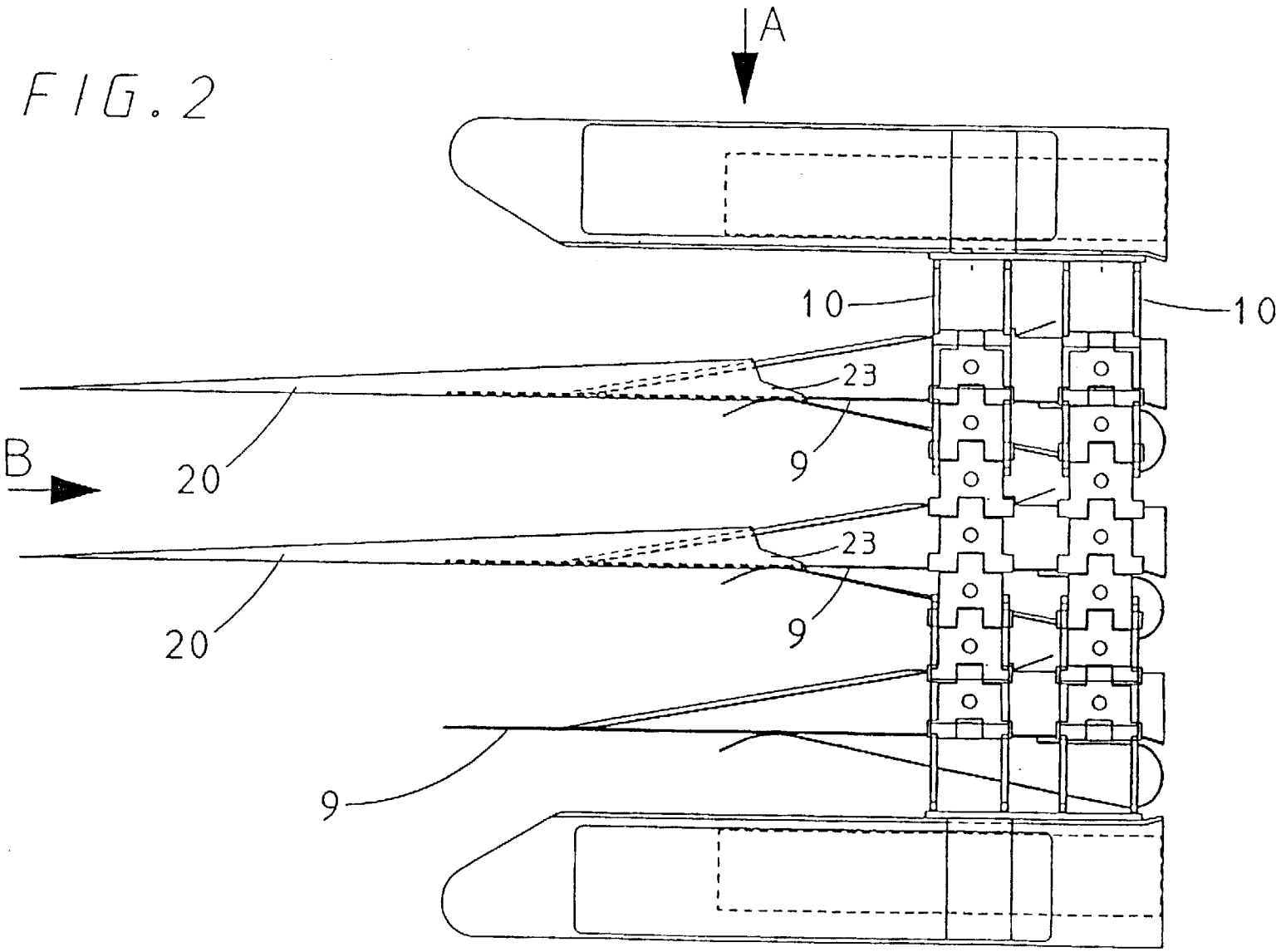
Figure 3:
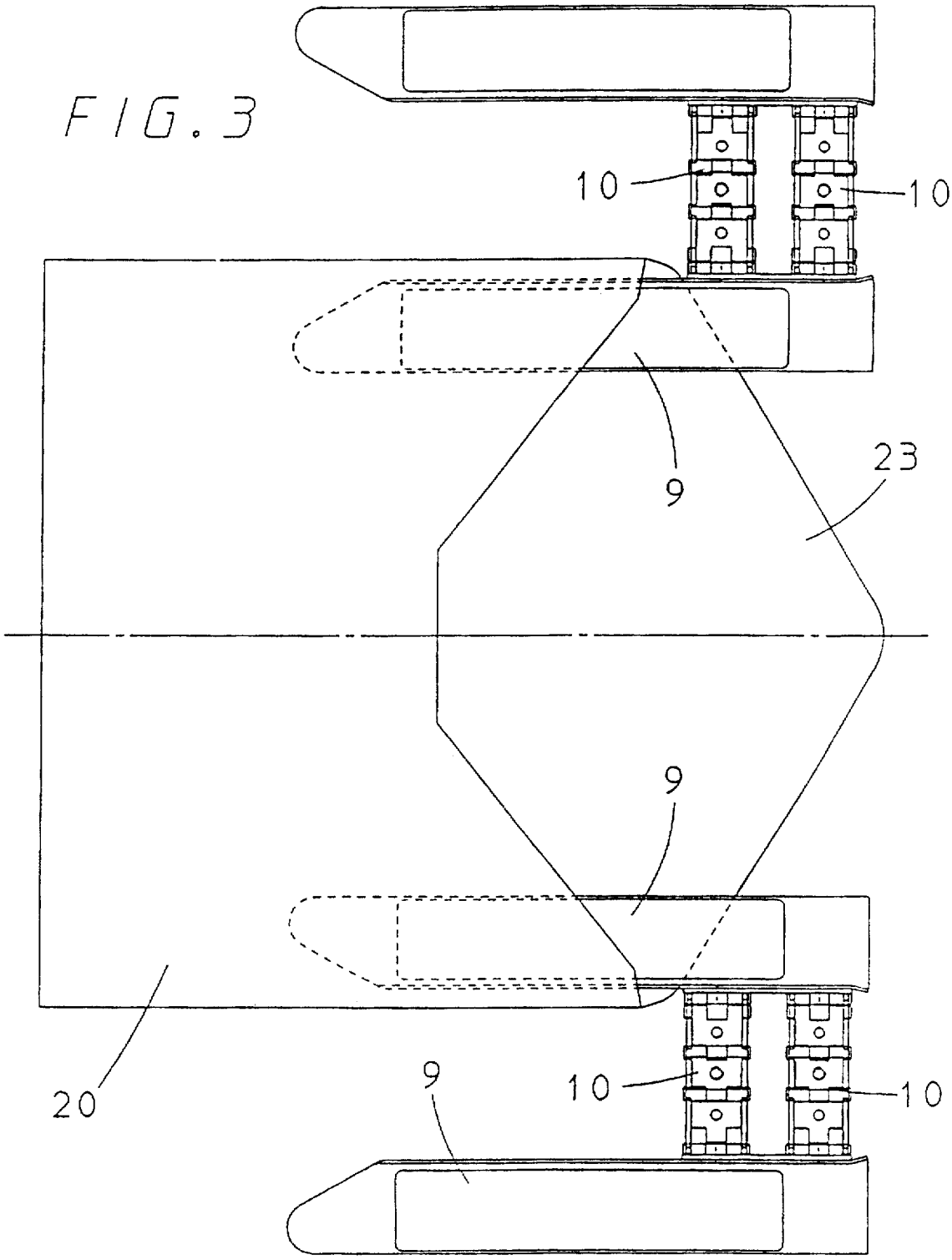
Figure 4:
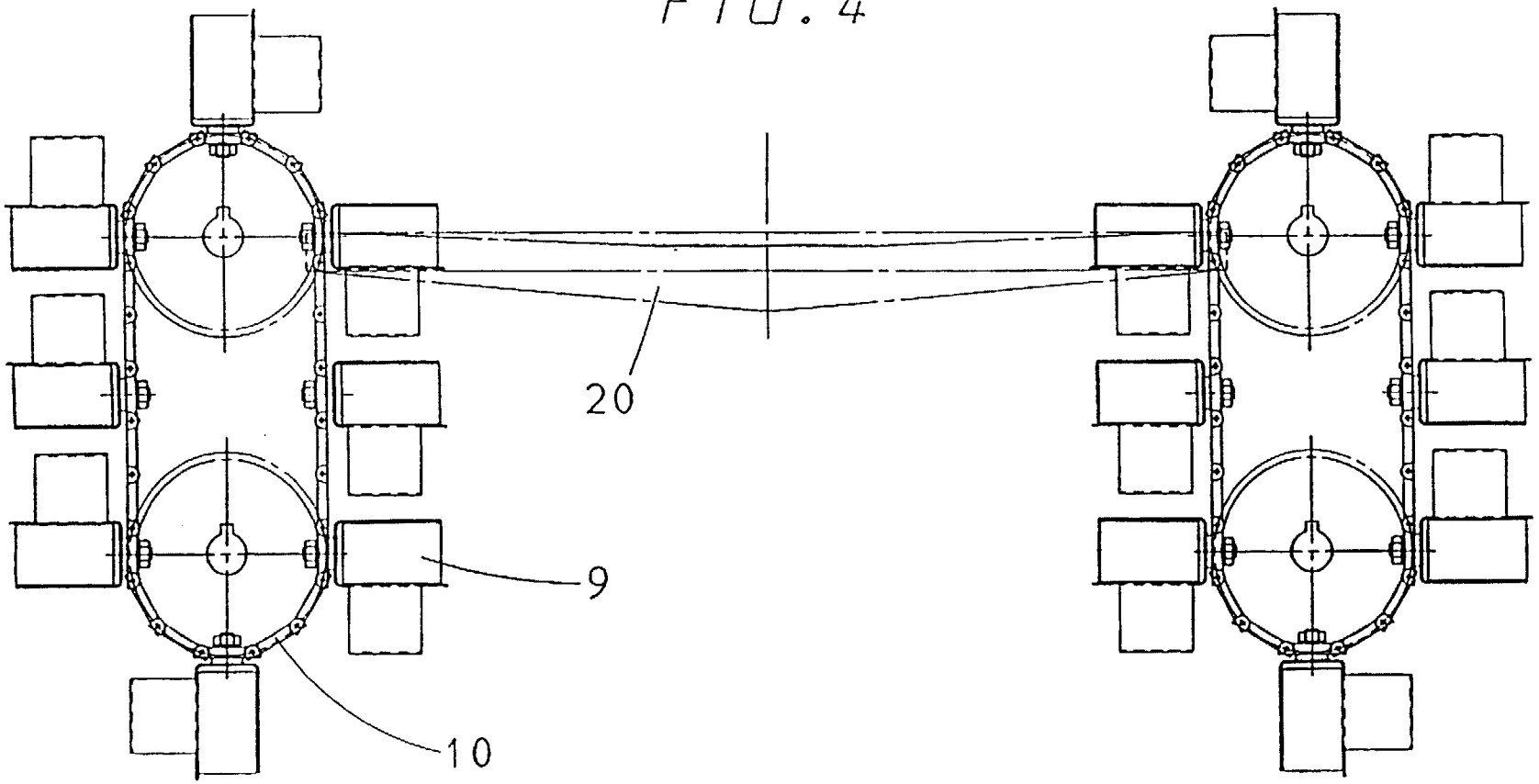
Figure 5:
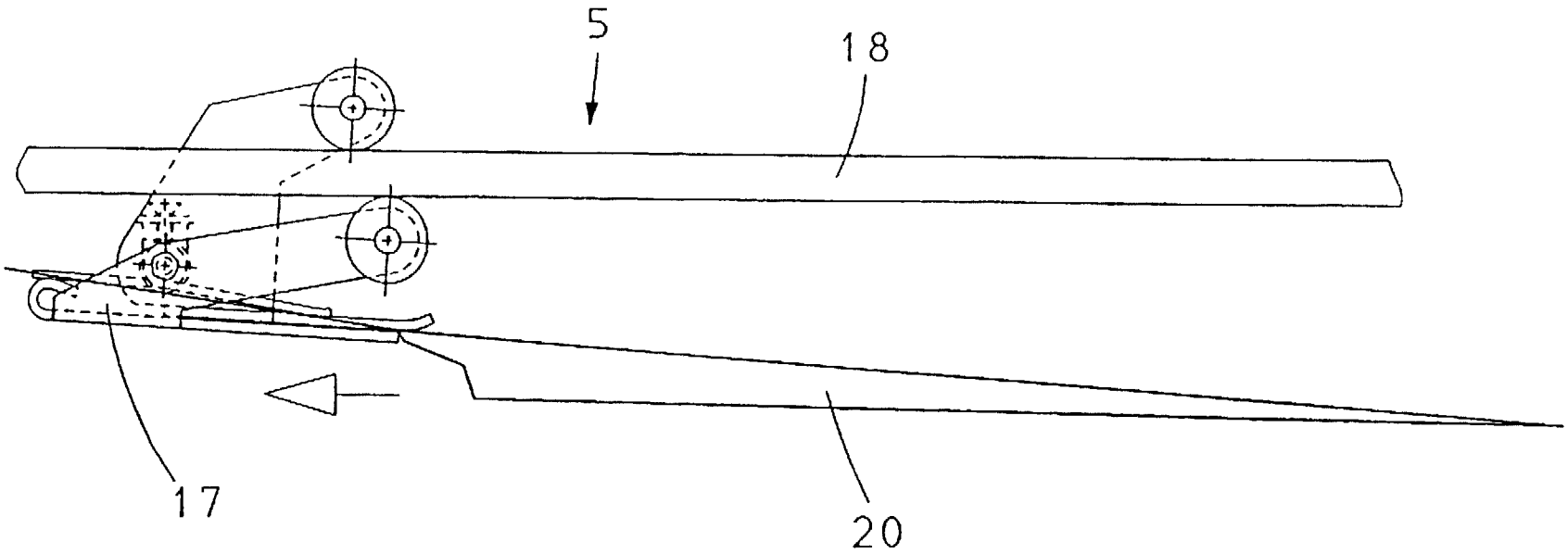
Figure 6:
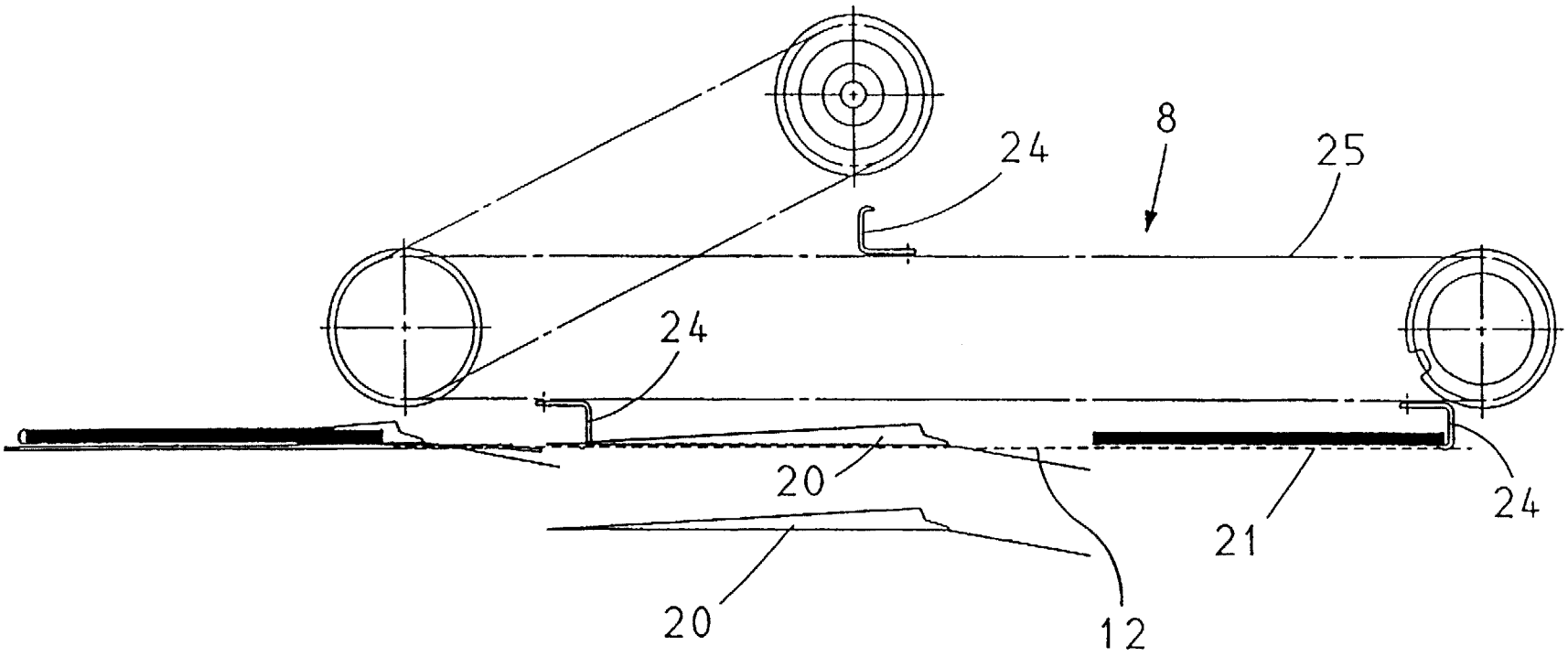

Details of the present invention are shown in the drawings schematically and as examples. In the drawings, FIG. 1 shows a schematic side view of an envelope-stuffing machine, FIG. 2 shows an enlarged side view of a spreading device for envelopes designated by (7) in FIG. 1, FIG. 3 shows a top view of the spreading device according to arrow A in FIG. 2, FIG. 4 shows a front view of the spreading device according to arrow B in FIG. 2, FIG. 5 shows an enlarged side view of a gripper designated by (17) in FIG. 1, and FIG. 6 shows an enlarged side view of the device for introducing the envelope contents into envelopes, which is designated by (8) in FIG. 1.

The exemplary embodiment shown in FIG. 1 is based on the fact that the envelopes (20) are pulled off from a stack (1), an intermediate stack, or a defined position by means of a pull-off device (2) and are transferred to a conveyor (5). This conveyor (5) is designed, e.g., as a revolving toothed belt, is provided with a plurality of grippers (17), and revolves around horizontal axes. It is essential for this conveyor (5) to form with its upper strand (19) a conveying plane (13) which extends horizontally. The lower strand (18) of this conveyor (5) extends, in contrast, in the pull-off plane of the pull-off device (2).

The conveying plane (12) of the conveyor (6) for envelope contents (21) is located at a marked vertical distance from the conveying plane (13) of the conveyor (5) for envelopes (20). These envelope contents (21) are located in one or more stacks (3), with which pull-off devices (4) are associated. It is possible as a result to combine an envelope contents (21) comprising a plurality of sheets on the conveyor (6) in order to feed this plurality of sheets as one pack into the envelope (20). However, it is conceivable that a plurality of stacks (3) are arranged for the same envelope contents (21) one behind the other to bring the envelope contents pulled off alternatingly onto the conveyor (6). The cycle times can be reduced as a result if the conveying capacity of the conveyor (6) for envelope contents is greater than the feeding capacity of the individual pull-off device (4).

The conveying plane (12) of the conveyor (6) for envelope contents (21) extends in parallel to the conveying plane (13) of the conveyor (5) for envelopes (20) and is located at a laterally markedly spaced location from this. This space between the two conveying planes (12, 13) is filled by a spreading device (7) for envelopes (20), which in turn comprises a link chain (10) which has a plurality of spreading members (9) (packing pockets), as is specifically shown in FIGS. 2 through 4. The link chain (10) revolves in a vertical conveying plane according to arrow 11 and is intended to bring the spreading members (9) into the range of action of the grippers (17) of the conveyor (5) for envelopes along the conveying plane (13) and then to raise them into the level of the conveying plane (12) of the conveyor (6) for envelope contents (21). Since the link chain (10) has a plurality of spreading members (9) located at equally spaced locations one behind the other, the opened envelope is fed into the spreading member (9) located in the conveying plane (13), while another spreading member (9) located in the conveying plane (12) keeps the spread envelope (20) contained [sic—probable type for "obtained"—Tr. Ed.] ready for pushing in the envelope contents (21) and for pulling off the stuffed envelope.

Consequently, the cycle times of the envelope-stuffing machine according to the present invention can be substantially reduced, because it is recommended that the conveyors (5 and 6) be allowed to revolve continuously, whereas the link chain (10) with the spreading members (9) is driven in an intermittent manner.

The link chain (10) with the spreading members (9) fastened to it is shown on a larger scale in the example shown in FIG. 2. While the lower spreading member (9) has not yet picked up any envelope,. it is recognized at the middle and upper spreading members (9) how the envelope (20) has been pushed, with its envelope flap (23) in front, onto the spreading members (9).

This pull-off process is especially dearly visible in FIG. 3. The spreading members (9), which are always located in an inner position,. extend into the edge area of the opened envelope (20) and hold same and also form a spreading of the envelope (20). The envelopes (20) are brought in this position to the level of the conveying plane (12) for the envelope contents (21).

The example in FIG. 4 shows that the link chain (10) is divided into two individual chains (14, 15) which revolve around parallel horizontal axes (16) at spaced locations from one another and may consist of, e.g., toothed belts. The spreading members (9) of the two individual chains (14, 15) are parallel to each other when they are in the conveying planes (12) and (13). An opened envelope is consequently pulled over two mutually opposite spreading members (9). The individual spreading member (9) therefore needs only to penetrate into the envelope edge associated with it, as a result of which maximum spreading is achieved, which makes it also possible to introduce a larger amount of envelope contents (21).

FIG. 5 shows on a larger scale how the envelope (20), pulled off and opened, is grasped by the gripper (17) of the envelope conveyor (5) and is carried along the lower strand (18) of this envelope conveyor (5) in the direction of the arrow.

The device for introducing the envelope contents (21) into envelopes (20), which is shown in FIG. 6 on a larger scale, comprises a conveyor (25), which is provided with carriers (24), and whose carriers (24) grasp the envelope contents (21) located on the conveying plane (12) on the rear side and push them into the envelopes (20) being kept ready.

LIST OF REFERENCE NUMBERS

1 Envelope (stack of envelopes) kept ready
2 Pull-off device for envelopes
3 Stack for envelope contents
4 Pull-off device for envelope contents
5 Conveyor for envelopes
6 Conveyor for envelope contents
7 Spreading device for envelopes
8 Device for introducing the envelope contents into envelopes
9 Spreading member
10 Link chain
11 Conveying plane of the link chain
12 Conveying plane of the conveyor for envelope contents
13 Conveying plane of the conveyor for envelopes
14 Individual chain
15 Individual chain
16 Parallel axes
17 Gripper
18 Lower strand
19 Upper strand
20 Envelope
21 Envelope contents
22 Conveyor for removing stuffed envelopes
23 Envelope flap
24 Carrier
25 Conveyor

I claim:

1. An envelope stuffing device, comprising:

a conveyor for removing stuffed envelopes;

envelope contents stacking and pull-off means for stacking and pulling off envelope contents, said envelope contents stacking and pull-off means including an envelope conveyor with an envelope conveying plane;

envelope stacking and pull-off means for stacking and pulling-off envelopes, said envelope stacking and pull-off means including an envelope conveyor with an envelope conveying plane;

spreading means for spreading open each envelope and positioning each envelope for introducing the envelope contents, said spreading open means including a revolving pair of link chains provided with a plurality of spreading members, said pair of link chains being disposed between an envelope conveying plane adjacent to said envelope pull-off means and an envelope contents conveying plane adjacent to said envelope contents pull-off means, said envelope conveying plane being located at a different level from said envelope contents conveying plane, said link chains being disposed at right angles to said envelope conveying plane and said envelope contents conveying plane; and intermittent drive means for driving said link chains intermittently whereby said spreading members of said pair of link chains pick-up envelopes in said envelope conveying plane during a stopped phase of said link chains, convey said picked-up envelope to said envelope contents conveying plane and push said envelope contents into said envelope at said envelope conveying plane.

2. An envelope stuffing device according to claim 1, wherein said envelope conveyor and said envelope contents conveyor are continuous conveyors revolving continuously.

3. An envelope stuffing device according to claim 2, wherein said envelope conveyor and said envelope contents conveyor provide transportation in a horizontal transfer plane and said link chains provide transportation in a vertical direction.

4. An envelope stuffing device according to claim 1, wherein said pair of link chains comprise two individual chains, arranged at spaced locations from one another, said chains revolving around mutually parallel axes, said spreading members being arranged on said individual chains in the same plane, said spreading members of one of said two individual chains being directed toward the spreading members of the other of said two individual chains.

5. An envelope stuffing device according to claim 1, wherein each of said individual chains has at least four spreading members arranged at equally spaced locations.

6. An envelope stuffing device according to claim 1, wherein each of said individual chains has eight spreading members arranged at equally spaced locations.

7. An envelope stuffing device according to claims 2, wherein said envelope conveyor includes a plurality of grippers arranged at equally spaced locations, each of said grippers for grasping an envelope flap and moving an envelope from said envelope stacking and pull-off means of said envelope conveying plane to said supporting members, said spreading members being located above said envelope conveying plane.

* * * * *